United States Patent [19]

Hoes et al.

[11] Patent Number: 5,026,074

[45] Date of Patent: Jun. 25, 1991

[54] ANNULAR METAL-TO-METAL SEAL

[75] Inventors: Larry M. Hoes, Spring; Joseph H. Hynes, Houston, both of Tex.

[73] Assignee: Cooper Industries, Inc., Houston, Tex.

[21] Appl. No.: 587,632

[22] Filed: Sep. 20, 1990

Related U.S. Application Data

[63] Continuation of Ser. No. 374,475, Jun. 30, 1989, abandoned.

[51] Int. Cl.[5] ..... F16J 15/48; E21B 33/03

[52] U.S. Cl. ..... 277/27; 166/115; 166/191; 277/198; 277/236; 285/96; 285/139

[58] Field of Search ..... 277/27, 116.6, 236, 277/116.2, 116.4, 118, 125, 198, 199, 205; 285/96, 133.1, 140, 106, 110–111, 133.2, 329, 351–352; 166/208, 182, 382, 115, 206, 387, 195, 120, 202, 184, 186, 191, 196

[56] References Cited

U.S. PATENT DOCUMENTS

| | | | |
|---|---|---|---|
| 2,007,501 | 7/1935 | Millmine . | |
| 2,401,923 | 6/1946 | Gleeson | 277/206 R |
| 3,378,269 | 4/1968 | Caster | 277/205 |
| 3,554,569 | 1/1971 | Gorman | 277/107 A X |
| 3,877,707 | 4/1975 | Syvakari | 277/198 X |
| 4,353,560 | 10/1982 | Tohill | 277/236 X |
| 4,719,971 | 1/1988 | Owens | 285/140 X |
| 4,742,874 | 5/1988 | Guillon . | |
| 4,751,965 | 6/1988 | Cassity | 277/125 X |
| 4,757,860 | 7/1988 | Reimert | 277/236 X |
| 4,771,828 | 9/1988 | Cassity . | |
| 4,784,222 | 11/1988 | Ford | 277/118 X |
| 4,791,987 | 12/1988 | Cassity et al. | 277/236 X |
| 4,848,806 | 7/1989 | Miller | 277/236 X |
| 4,854,615 | 8/1989 | Smith, III | 277/205 X |

FOREIGN PATENT DOCUMENTS

| | | | |
|---|---|---|---|
| 1008969 | 5/1957 | Fed. Rep. of Germany | 277/205 |
| 49737 | 8/1966 | German Democratic Rep. | 277/205 |
| 24396 | of 1905 | United Kingdom | 277/205 |

*Primary Examiner*—William A. Cuchlinski, Jr.
*Assistant Examiner*—Scott Cummings

[57] ABSTRACT

The improved annular seal of the present invention provides a seal across an annular space between facing cylindrical surfaces and includes an outer annular ring, inner annular ring, the gap between the outer annular ring and the inner annular ring being suitably sealed at one end thereof so that the open end is open to admit pressure which is to be sealed between the two rings, an outer sealing element on the exterior of said outer annular ring, and an inner sealing element on the interior of the inner annular ring so that pressure exerted between the annular rings urges them apart and their sealing elements against the surfaces of the annular space. In another form of the invention three annular rings are provided with one end of the inner and outer rings being sealing to the end of the intermediate ring and with sealing elements on the exterior of the outer ring and on the interior of the inner ring so that the sealing elements are urged into sealing engagement with the surfaces of the annular space. Another form of the invention includes annular rings which vary in thickness from one end to the other so that they may have greater or less flexibility as needed to provide a response to the pressure responsive movements of the inner and outer members.

6 Claims, 4 Drawing Sheets

ANNULAR METAL-TO-METAL SEAL

This is a continuation of application Ser. No. 07/374,475 filed on June 30, 1989, abandoned.

BACKGROUND

The present invention relates to an improved annular seal which can be used to seal across the annular space between well members. Difficulty has been encountered in the past with annular seals since manufacturing tolerances and deflection of components due to hoop strain creates an extrusion gap and adversely affects the ability to seal, the seal life and for elastomers causes extrusion problems.

Efforts have been made in prior seal assemblies to provide a structure in which the pressure to which the seal is exposed is utilized to cause a lip to move in the direction to provide a sealing engagement with a cylindrical surface against which the seal is to be provided.

The H. W. Millmine U.S. Pat. No. 2,007,501 discloses a packing for a pump rod which is rubber or similar material and includes an outer lip and an inner lip with a compression space between the lips. The fluid being pumped is received within the compression space and exerts a pressure against both lips to hold them in sealing engagement with the surfaces against which they are to seal. A plurality of channels through the packing connect the compression space with a recess on the interior of the packing to provide cooling for the reciprocating rod which moves within the packing. A filter is provided at the intersection of the duct and the compression space to prevent the entry of sand and sediment into the rod cooling recess.

The S. D. Gullion U.S. Pat. No. 4,742,874 discloses a subsea wellhead seal assembly for sealing between the interior of a wellhead housing and the exterior of a hanger. The seal assembly includes a U-shaped metal seal ring with a pair of interengaged annular wedging members which are forced into the interior of the U-shaped metal seal ring to cause its inner and outer legs to be spread apart into sealing engagement with the walls on the interior of the housing and the exterior of the hanger.

The T. G. Cassity U.S. Pat. No. 4,771,828 discloses a wellhead seal which includes an annular sealing member for sealing across the annular space between two wellhead members. The annular sealing member includes a plurality of inner and outer lips which are tapered in a direction toward the surface against which they are to seal and toward the pressure to which they may be exposed. The sealing surfaces of the wellhead members are prepared to provide an undercut on the sealing surfaces so that the pressure to which the seal is exposed can enter the undercut space and urge the undercut portion of the sealing surface in the direction toward the annular sealing member. In this manner the pressure being sealed urges both the seal lips on the annular sealing member and the undercut sealing surface portions toward each other to provide a positive seal.

SUMMARY

The present invention relates to an improved annular seal for sealing across an annular space between facing cylindrical surfaces and includes an outer annular ring, inner annular ring, the gap between the outer annular ring and the inner annular ring being suitably sealed at one end thereof so that the open end is open to pressure which is to be sealed, an outer sealing element on the exterior of said outer annular ring, and an inner sealing element on the interior of said inner annular ring so that pressure exerted between the annular rings urges them apart and their sealing elements against the surfaces of the annular space. In another form of the invention three annular rings are provided with one end of the inner and outer rings being sealed to the end of the intermediate ring and with sealing elements on the exterior of the outer ring and on the interior of the inner ring so that the sealing elements are urged into sealing engagement with the surfaces of the annular space.

An object of the present invention is to provide an improved annular pressure seal having a longer active seal life.

Another object is to provide an improved annular pressure seal in which changes in the annular space due to deflections of the well members by the pressure being sealed does not alter the effectiveness of the seal.

A further object is to provide an improved annular pressure seal in which the pressure is utilized to allow the seal to accommodate changes in the annular space across which it is to seal which may be caused by manufacturing tolerances or may be a result of deflections of components caused by the pressure to which the annular space is exposed.

Still another object is to provide an improved annular pressure seal in which a pressure responsive element is provided between inner and outer seals to ensure the maintenance of the sealing engagement of the seals with the surfaces against which they are to seal.

BRIEF DESCRIPTION OF THE DRAWINGS

These and other objects are hereinafter set forth, described and explained with reference to the drawings wherein.

DESCRIPTION OF THE PREFERRED EMBODIMENTS

Figure 1:
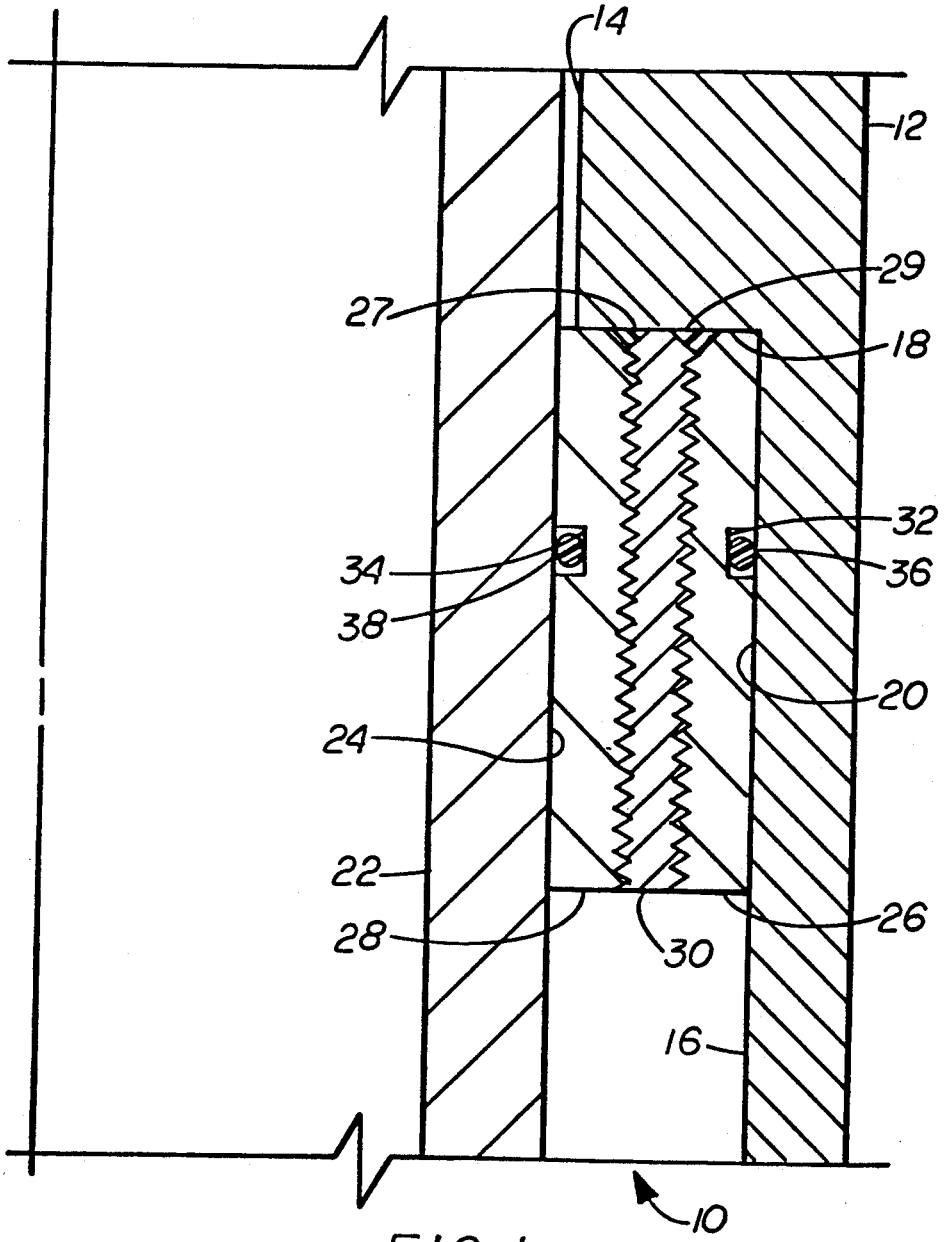
FIG. 1 is a partial sectional view of the improved seal of the present invention positioned between well members with facing cylindrical surfaces between which the seal is provided.

In FIG. 1 improved seal 10 of the present invention is illustrated within first tubular member 12 having upper bore 14 and counterbore 16 with shoulder 18 therebetween. The surface 20 of counterbore 16 is one of the sealing surfaces against which seal 10 is to seal. Second tubular member 22 has outer sealing surface 24 which is the other of the sealing surfaces against which seal 10 is to seal. In this manner seal 10 provides an annulus seal for sealing between members 12 and 22.

Seal 10 includes outer ring 26, inner ring 28 and intermediate ring 30. As shown, rings 26, 28 and 30 are threadedly engaged with suitable threading and having welding securing and sealing the upper end of rings 26 and 30 and of rings 28 and 30. The welding is at the end of rings 26, 28 and 30 opposite to the pressure end, i.e., the pressure is exerted on seal 10 from below and the non welded ends of the ring are herein termed the pressure end. The welded ends of rings 26, 28 and 30 are positioned against shoulder 18 as shown. Groove 32 in the exterior of outer ring 26 is provided a substantial distance from the welded end of rings 26 and 30 and groove 34 in the interior of inner ring 28 is provided a substantial distance from the welded end of rings 28 and 30. Suitable sealing means is provided within grooves 32 and 34, such as O rings 36 and 38, for sealing against the facing sealing surfaces 20 and 24.

The threaded engagement between ring 26 and ring 30 and between ring 30 and ring 28 is such that the pressure fluid which is exerted on seal from below enters between the rings and urges outer ring outwardly to assist in the sealing of O ring 36 against sealing surface 20 and urges inner ring 28 inwardly to assist in the sealing of O ring 38 against sealing surface 24.

The pressure within the threaded surfaces between the rings and above the seals 36 and 38 creates the force necessary to urge the inner and outer rings 26 and 28 toward their respective sealing surface so that the pressure exerted on the inner and outer tubular members 12 and 22 which may create an extrusion gap between the rings and the sealing surfaces does not occur because of the compensating pressure responsive movement of the rings 26 and 28.

Seal 10 as shown in FIG. 1 and described above is a simplified seal to illustrate the novel features of the present invention. Other forms of the invention are shown in the drawings but show additional details of the seals.

Figure 2:
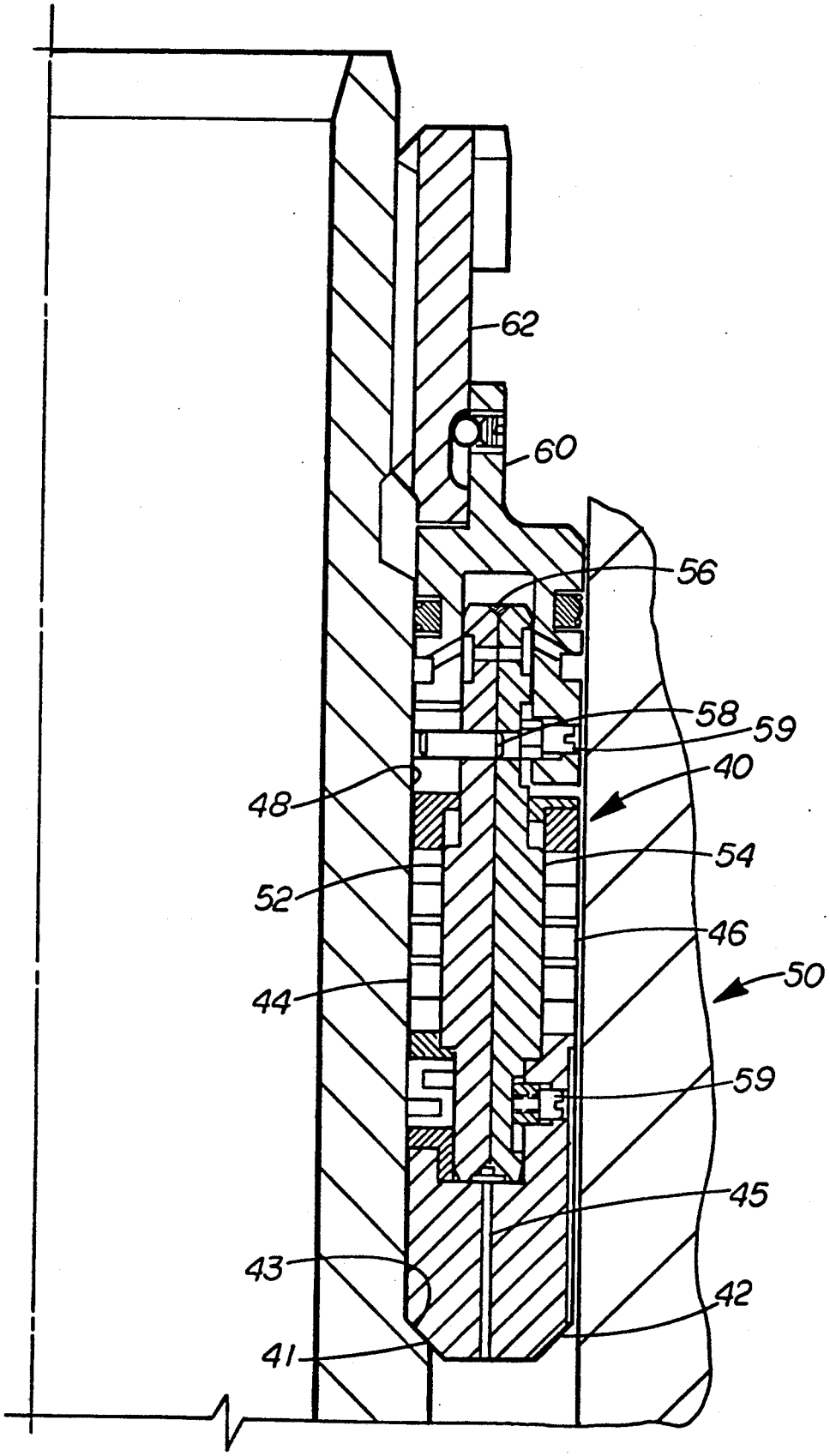
FIG. 2 is another partial sectional view of a modified form of the improved seal of the present invention.

In the form of the present invention shown in FIG. 2, an improved annulus seal 40 is shown which includes lower body 42 having shoulder 41 which lands on seat 43, a plurality of bores 45 extending therethrough to transmit pressure from a position below body 42 to a position above body 42 which is between inner seal stack 44 and outer seal stack 46. Since body 42 is annular in shape, inner seal stack 44 includes a stack of sealing elements, anti-extrusion rings and other back-up elements which provide a suitable seal against the exterior of the inner member 48 and outer seal stack 46 includes a stack of sealing elements, anti-extrusion rings and other back-up elements which provide a suitable seal against the interior of outer member 50. Positioned within stacks 44 and 46 are inner ring 52 and outer ring 54. Rings 52 and 54 are secured and sealed together at their upper ends by weld 56. With pressure exerted on seal 40 from below, this pressure is exerted between rings 52 and 54 to cause them to be wedged apart to assist in the sealing forces exerted by stacks 44 and 46 in their sealing function. Suitable means 58 is provided to secure rings 52 and 54 in the desired position within stacks 44 and 46 and means 59 secures rings 52 and 54 to body 42 and cap ring 60. Cap ring 60 is secured to the upper ends of rings 52 and 54 and cap ring 60 is supported on sleeve 62, as shown, for lowering seal 40 into position between members 48 and 50.

Figure 4:
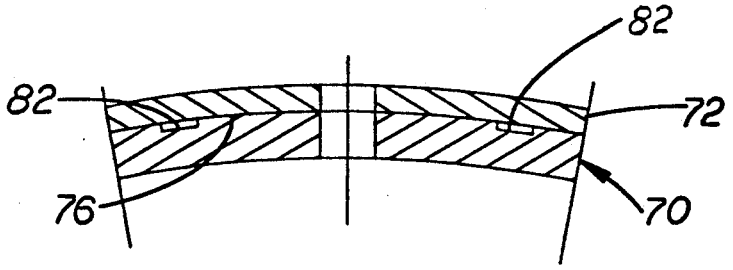
FIG. 4 is a partial transverse sectional view of the seal taken along line 4—4 in FIG. 3.
Figure 3:
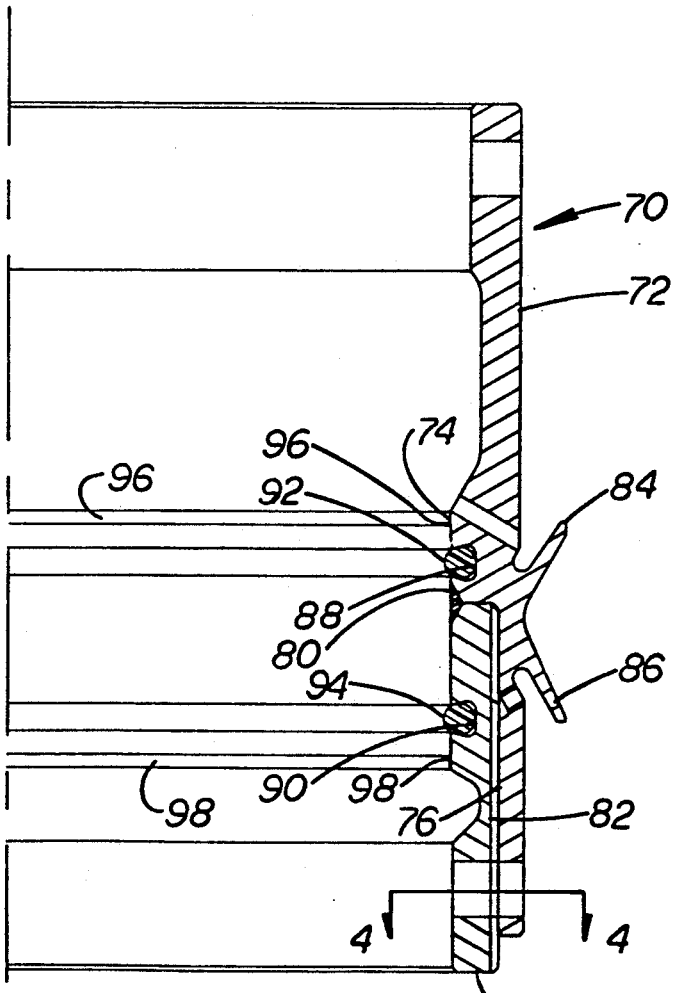
FIG. 3 is another partial sectional view of another modified form of the improved seal of the present invention which forms the annulus seal in a wellhead.

Seal 70 shown in FIGS. 3 and 4 is a seal for use as an annulus seal for sealing across the annulus between the exterior of a hanger and the interior of a housing in which the hanger is landed. In sealing an annulus between a housing and a hanger landed therein, two sources of pressure can be encountered. If there is a fault in the cementing of the casing some pressure fluid may move upward in the space around the casing and enter the annulus within the housing to exert a pressure within the housing from a position below the annulus seal. This pressure is exerted to urge the housing outward and to urge the hanger inwardly. There would be no balancing or equalizing pressure within the hanger. In the other case, a pressure pocket could be encountered while drilling through the hanger and a pressure kick would be exerted through the interior of the hanger. To control such pressure kick, the blowout preventers above the hanger would be closed and the pressure would be exerted within the hanger and within the annulus above the seal. This pressure causes the housing to be urged outwardly and since there is no balancing or equalizing pressure around the major portion of the exterior of the hanger, there is an appreciable net force urging the hanger outward. The seal 70 is an improved seal structure which will maintain a sealing engagement across the annulus under either pressure condition described above.

Seal 70 includes tubular body 72 having central bore 74 and counterbore 76 extending therein from one end and body ring 78 which is positioned within counterbore 76 and is secured therein by welding 80. Grooves 82 in the exterior of body ring 78 provide communication for pressure fluids to enter between body ring 78 and counterbore 76 of body 72. Body 72 is configured on its exterior surface to provide annular seal lips 84 and 86 which are both tapered in a radially outward direction with upper seal lip 84 being directed upwardly and lower seal lip 86 being directed downwardly. Annular seal lips 84 and 86 are designed to seal against the interior of a housing bore. Groove 88 is provided in the interior of body 72 and groove 90 which is similar to groove 88 is provided in the interior of body ring 78. Elastomeric seals 92 and 94 are positioned in grooves 88 and 90 to seal against the exterior of a hanger which forms the interior of the annulus across which seal 70 is to seal.

Seal 70 includes the two main components, i.e., body 72 and body ring 78. It is preferred that body ring 78 be of a high strength metal and body 72 be of a soft material such as mild steel. With this configuration and with the materials suggested body ring 78 being of a high strength material maximizes the amount of stored energy from an interference fit of the interior of body ring 78 with respect to the inner sealing surface of the annulus. Also, the material of body 72 maximizes the ability of the seal lips to seal against scratches and other imperfections in the inner surface of the outer member of the annulus being sealed. The seal 70 also utilizes the pressure in the annulus in which it is positioned to urge body ring 78 inward and the lower portion of body 72 outward to assist in both the internal and external sealing of seal 70. It should be noted that the inner surface 96 upward of groove 88 is slightly smaller in diameter than bore 74 to provide an interference fit when seal 70 is installed around a hanger and similarly surface 98 which is at the other end of the inner surface or body ring 78 has a similar smaller diameter to provide an interference fit with the exterior of the surface against which seal 70 is to seal. With such sealing surfaces as surfaces 96 and 98 it is possible to eliminate the use of the elastomeric seals 92 and 94. Since such seals can be added immediately before the lowering of seal 70 into a well bore to seal around a hanger landed within an annulus, seal 70 can be provided without seals 92 and 94 and they can be added if desired immediately prior to their use.

It is suggested that by varying the relative thickness of body 72 around counterbore 76 and the thickness of body ring 78, the respective movements of each can be adjusted so that they readily move with the movement of the hanger and the housing responsive to the pressure experienced in the annulus from below.

When the improved seal 70 is in position and subjected to pressure from below in the housing-hanger annulus, the grooves 82 in body ring 78 allow such pressure to be exerted to urge body ring 78 inwardly and tubular body 72 outwardly to thereby at least partially compensate for the action of the pressure on the housing and the hanger. It is not generally felt that pressure from within the hanger which is also felt in the upper end of the annulus requires any similar compensation for the relative movement of the hanger and housing responsive to such pressure since the hanger would not move, having the pressure exerted both on its interior and its exterior and the amount of movement of the housing would be accommodated by the action of the seal lips 84 and 86.

A further advantage of the present invention is that it does allow the pressure from the lower end of the annulus to be exerted between body ring 78 and tubular body 72 through the grooves 82 but this is done without sacrificing the relative strength of the structure so that during the setting of seal lips 84 and 86 with setting sleeves, the total structure- of tubular body 72 and body ring 78 resist any inward forces developed during such setting. This results from the groove structure but would not result if there were a complete annular space between tubular body 72 and body ring 78 since in such structure body ring 78 would not contribute to resisting the setting loads of the seal lip setting sleeve.

Figure 5:
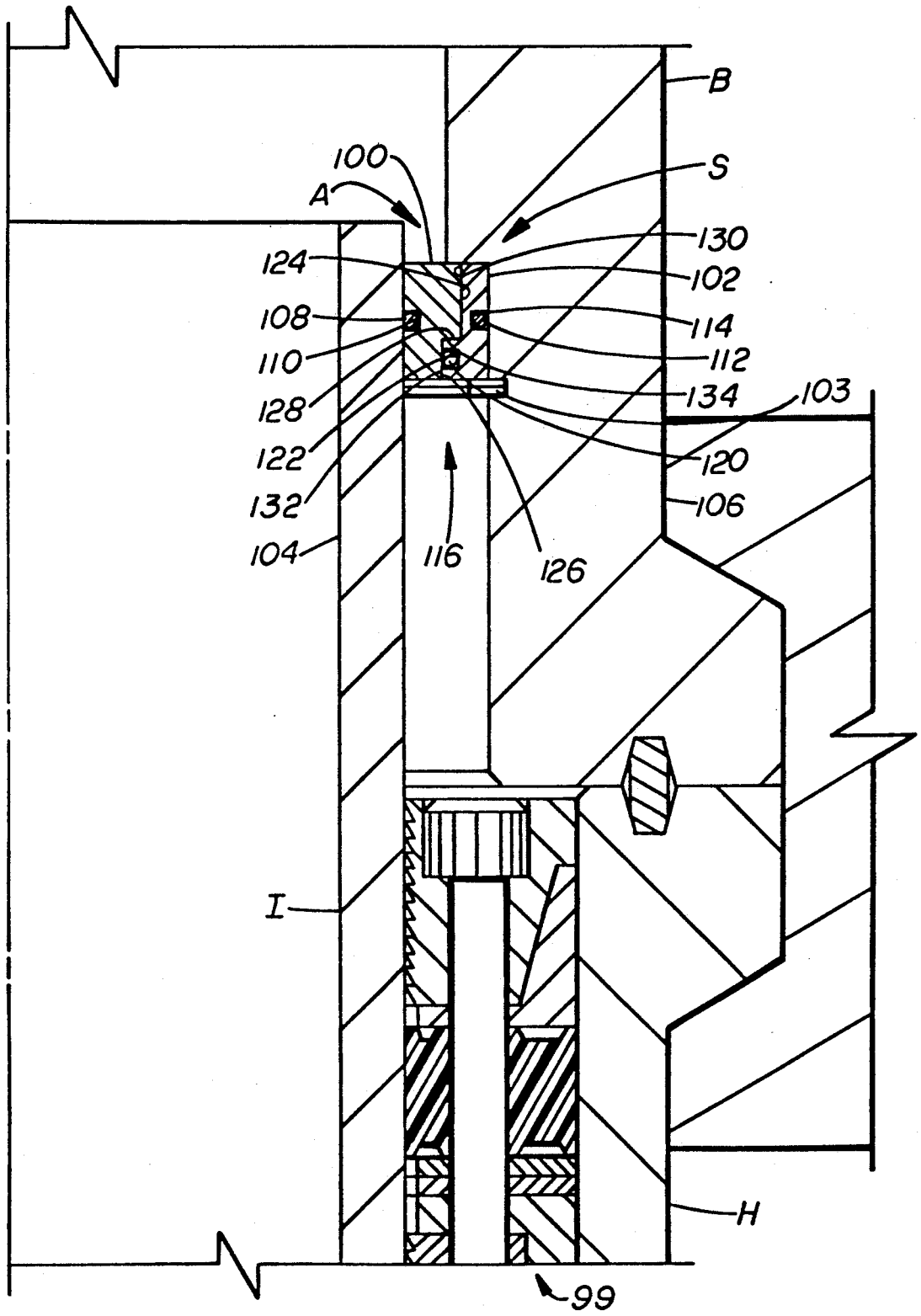
FIG. 5 is a partial sectional view of a modified form of seal of the present invention.

It should be noted that any suitable sealing means, including O ring seals, may be used to seal the closed end of the opening between rings so long as it maintains the seal under all pressure and other conditions to which it may be exposed. Further, the thickness of the rings may be varied from one end to the other to provide the desired structure for each application, as shown in FIG. 5 wherein the improved seal S of the present invention is positioned within annulus A between spool B which is secured to housing H and inner string I which is supported within housing H by sealing and supporting assembly 99. Seal S includes two rings 100 and 102 which are suitably supported by snap ring 103 in position in the annulus between inner member 104 and outer member 106. Seal S also includes inner seal 108 which is positioned in groove 110 on the interior of inner ring 100 and adapted to seal against the exterior of inner member 104 and outer seal 112 which is positioned in groove 114 on the exterior of outer ring 102 and adapted to seal against the interior of outer member 106. This structure makes up sealing assembly 116 which seals across the annulus A between members 104 and 106 and is subjected to pressure which is within inner member 104 and is transmitted into annulus A above sealing assembly 116. Under such conditions pressure is applied from one direction only and the pressure is from within inner member 104 and is exerted both within and around the exterior of inner member 104 above sealing assembly 116. Inner member 104 is thus in equilibrium and will not deflect in the area down to sealing assembly 116 as pressure increases. Outer member 106 which is not in equilibrium will deflect as pressure is applied. A suitable seal is provided between inner ring 100 and outer ring 102 by sealing element 120 which is positioned in groove 122 on the lower interior of ring 102. Ring 100 has a stepped outer surface with upper surface 124 being of a larger diameter than lower surface 126. Shoulder 128 is positioned between surfaces 124 and 126. Ring 102 is provided with an internal configuration including upper surface 130 which is larger in diameter than lower surface 132 and shoulder 134 is positioned between surfaces 130 and 132 as shown. This structure allows the upper portion of ring 102 to be relatively flexible and to easily deflect with pressure between rings 100 and 102. The lower portion of ring 102 being much thicker will not deflect nearly as much because of the relative stiffness of its wall section. Also, at the point of sealing between the two rings 100 and 102, sealing element 120, both rings are relatively thick and will have relatively little deflection which ensures the maintenance of the sealing of element 120 between the members 100 and 102.

What is claimed is:

1. An annular metal-to-metal seal for sealing against the flow of pressure fluid through an annular space between an outer member having an internal cylindrical sealing surface and an inner member having an external cylindrical sealing surface comprising a first tubular metal ring having a pressure end and an opposite end, a second tubular metal ring positioned within said first tubular metal ring and having a pressure end and an opposite end, sealing means on the exterior of said first tubular metal ring spaced from the opposite end thereof, sealing means on the interior of said second tubular metal ring spaced from the opposite end thereof, a plurality of longitudinally circumferentially spaced directed passages between said first metal ring and said second metal ring to allow entry of fluid between said metal rings at their pressure end to urge the first and second metal rings into sealing engagement with said inner and outer members, and means securing said metal rings together in sealed relationship at their opposite ends to block the flow of pressure fluid between the metal rings in the longitudinal passages so that such pressure in the portion of the passages near their sealed ends will urge the unsealed end of the rings apart.

2. An annular metal-to-metal seal according to claim 1 wherein said exterior sealing means includes a pair of diverging legs extending outwardly from said first tubular metal ring, and said interior sealing means includes a resilient sealing ring positioned in an annular groove in the interior of said second metal ring.

3. An annular metal-to-metal seal according to claim 1 including an upper and a lower smaller diameter on the interior of said second tubular metal ring to provide an interference fit metal-to-metal seal therein.

4. An annular metal-to-metal seal according to claim 1 wherein said sealing means includes an upper interior groove and a lower interior groove, resilient seal rings positioned in said upper and lower interior grooves, and an upper smaller diameter on the interior of said second tubular metal ring above said upper interior groove and a lower smaller diameter on the interior of said second tubular metal ring below said lower interior groove to provide an interference fit metal-to-metal seal therein.

5. An annular metal-to-metal seal for sealing across the annular space between inner and outer facing cylindrical surfaces comprising an outer metal seal ring, an inner metal seal ring, an intermediate metal seal ring positioned between said inner and said outer seal rings, a first longitudinally directed passage between said inner and said intermediate rings and a second longitudinally directed passage between said outer and said intermediate rings, said passages allowing entry of fluid between the rings to urge said inner and outer metal seal rings into engagement with said inner and outer cylindrical surfaces, and means securing one end of the intermediate seal ring to both said outer seal ring and said inner seal rings so that the spaces between said rings are sealed at one end which also is opposite the end to which the seal rings are exposed to pressure.

6. An annular metal-to-metal seal according to claim 1 wherein said securing means consists of welds securing said intermediate ring to said inner and outer rings at their respective opposite ends.

* * * * *